United States Patent [19]

Regula

[11] Patent Number: 4,706,394

[45] Date of Patent: Nov. 17, 1987

[54] GOLF SPIKE HOLDER

[76] Inventor: Stanley J. Regula, 823 La Jolla Ave., Sun City Center, Fla. 33570

[21] Appl. No.: 939,963

[22] Filed: Dec. 10, 1986

Related U.S. Application Data

[63] Continuation-in-part of Ser. No. 713,345, Mar. 18, 1985, abandoned.

[51] Int. Cl.[4] ..... A43B 5/00; A43C 15/00

[52] U.S. Cl. ..... 36/67 D; 36/134; 36/127; 36/59 R

[58] Field of Search ..... 36/59 R, 61, 62, 67 D, 36/134, 67 R, 127

[56] References Cited

U.S. PATENT DOCUMENTS

| | | | |
|---|---|---|---|
| 3,101,763 | 8/1963 | McGehee | 36/67 D |
| 3,782,011 | 1/1974 | Fisher | 36/134 |
| 3,882,614 | 5/1975 | Albaladejo | 36/67 D |
| 4,299,038 | 11/1981 | Epple | 36/67 D |
| 4,523,396 | 6/1985 | Dassler | 36/67 D |

FOREIGN PATENT DOCUMENTS

| | | | |
|---|---|---|---|
| 2501561 | 7/1976 | Fed. Rep. of Germany | 36/134 |
| 1426358 | 12/1965 | France | 36/134 |
| 401185 | 11/1933 | United Kingdom | 36/67 D |

*Primary Examiner*—Ronald Feldbaum
*Assistant Examiner*—Steven N. Meyers
*Attorney, Agent, or Firm*—Dominik, Stein, Saccocio & Reese

[57] ABSTRACT

A replaceable retention system for mounting golf spikes, cleats, and the like to the bottom of a shoe sole including a transverse plate and a holder. The holder is adapted to be insertable into a prepared cavity in the sole of the shoe and also includes an interior thread for receiving the threaded shank of a spike. The plate slidably engages structure in the holder which supports the plate in a transverse orientation to the interior thread of the holder whereby the threaded shank of the spike contacts and secures the plate in this arrangement. By this configuration, the plate may be inserted between the lower and upper layers of the sole for securely retaining the holder in position within the cavity in the lower layer of the sole. The removal and replacement of the plate, holders and spikes is thus facilitated by this invention.

8 Claims, 14 Drawing Figures

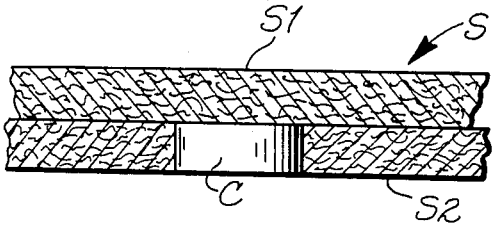
Fig. 7
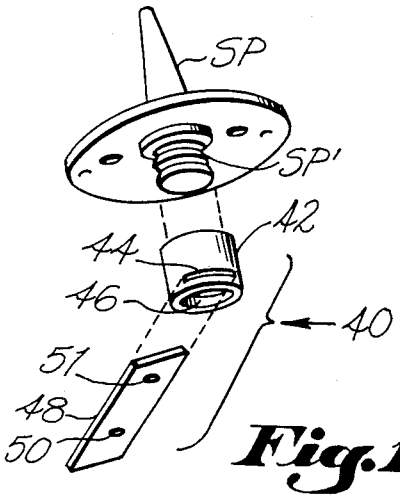
Fig. 12
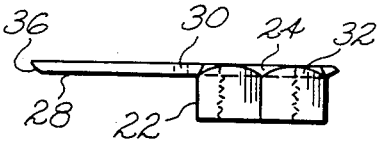
Fig. 8
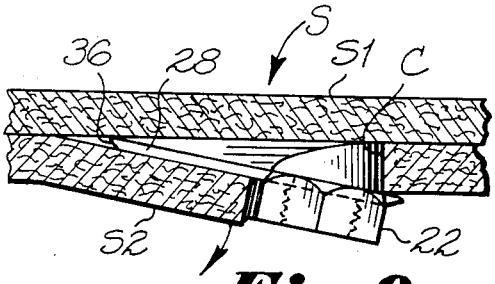
Fig. 9
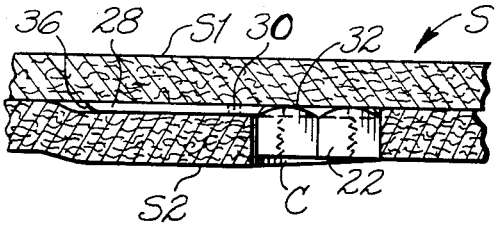
Fig. 10
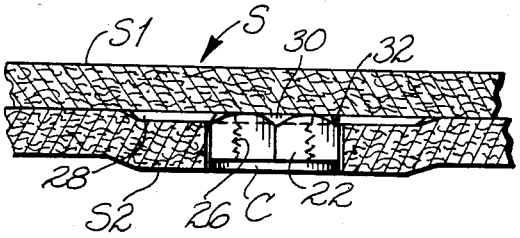
Fig. 11
Fig. 13
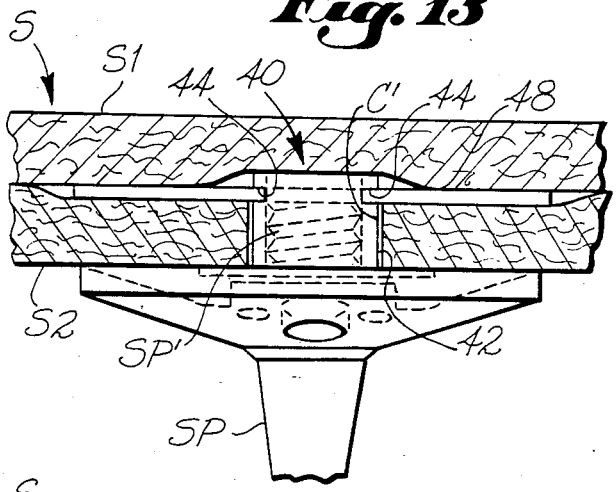
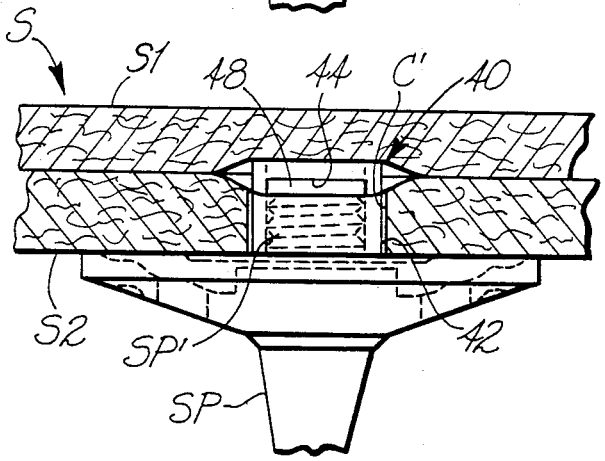
Fig. 14

GOLF SPIKE HOLDER

BACKGROUND OF THE INVENTION

This is a continuation in part application of Ser. No. 06/713,345 filed Mar. 18, 1985, abandoned.

This invention relates generally to shoes having spikes, cleats and the like downwardly disposed from the sole of the shoe, and more particularly to a replaceable retention system for such spikes mounted in the sole.

Spikes, cleats and the like used in conjunction with shoes such as athletic shoes are well known. One particular application is in conjunction with golf shoes which have relatively sharp spikes disposed downwardly from the sole of the shoe.

Most spiked and cleated shoes include a means for replacing the spikes and cleats when they become worn. These terrain gripping extensions disposed from the lower surface of the shoe are generally threadably engaged into reinforcements installed in the sole of the shoe. In many cases both the spike and its threaded holder mounted within the sole are fabricated of metal such as steel or aluminum. These components are routinely exposed to moisture and minerals in the ground, as well as dirt, grass and the like during use. Thus, during the period of time when the cleats and spikes become worn and require replacement, the holders, likewise, become deteriorated.

Many prior art inventions are directed variously to improvements and retention and/or structure of the cleats and their holders. Such references are disclosed in the following U.S. Patents:

| Inventor | U.S. Pat. No. |
|---|---|
| Anthony Ernest Lillie | 728,931 |
| Anthony Ernest Lillie | 732,328 |
| Howard M. Pierce, et al. | 2,178,106 |
| G. C. Birchfield | 2,185,397 |
| A. A. Langer | 2,607,134 |
| N. A. Camody | 2,629,943 |
| A. B. McGehee | 3,101,763 |
| H. W. Turner | 3,267,593 |
| J. P. Kowal | 3,343,285 |
| Pierre Albaladejo | 3,882,614 |
| Arden B. McNeill | 4,063,372 |
| Neil P. Reddien | 4,330,950 |

Without belaboring further discussion of the above references, suffice it to say that, as applicant understands these inventions, they are all directed variously to structures which enhance retention and/or facilitate replacement of only the spikes and cleats themselves. None of these inventions are directed to means for replacing the holders or spike and cleat retention means embedded within the sole of the shoe.

Thus, the user of such footwear is relegated to discarding an otherwise useful pair of shoes, such as golf shoes, when the holders embedded in the sole become rusted and otherwise deteriorated so as to prevent or inhibit replacement of the spike's when worn. This deterioration may be in the form of excessive rust buildup preventing the threaded shank of the spike's engagement therein or the locking or binding of the threaded spike shank in the holder causing the holder to break loose and spin within the sole of the shoe. In this latter instance, because the holder is no longer firmly secured within the sole of the shoe and the user has no way of grasping same, the spike, being partially inserted, usually also renders the footwear unusable for further use.

The present invention provides a replaceable spike and cleat holder system which facilitates, both in existing and newly manufactured footwear, the installation of the invention of a spike and cleat holder which is, itself, replaceable, in addition to facilitating the routine replacement of the spikes and cleats. The invention is simple and inexpensive to manufacture and is virtually foolproof in its functioning and replacement.

SUMMARY OF THE INVENTION

This invention is directed to a replaceable retention system for mounting golf spikes, cleats, and the like to the bottom of a shoe sole including a transverse plate and a holder. The holder is adapted to be insertable into a prepared cavity in the sole of the shoe and also includes an interior thread for receiving the threaded shank of a spike. The plate slidably engages structure in the holder which supports the plate in a transverse orientation to the interior thread of the holder whereby the threaded shank of the spike contacts and secures the plate in this arrangement. By this configuration, the plate may be inserted between the lower and upper layers of the sole for securely retaining the holder in position within the cavity in the lower layer of the sole. The removal and replacement of the plate, holders and spikes is thus facilitated by this invention.

It is therefore an object of this invention to provide a replaceable holder system for spikes, cleats and the like.

It is another object to provide the above invention which readily facilitates replacement of the spikes and cleats.

It is another object to provide the above invention which may be adapted to both existing and newly manufactured footwear.

In accordance with these and other objects which will become apparent hereinafter, the instant invention will now be described with reference to the accompanying drawings in which:

BRIEF DESCRIPTION OF THE DRAWINGS

FIG. 7 is an elevation section view of a portion of the sole of a shoe.

FIG. 8 is a side elevation view of the assembled holder and transverse plate shown in FIG. 3.

FIGS. 9, 10 and 11 show the sequence of installation of the assembled holder and transverse plate as shown in FIG. 8 into the sole of the shoe.

FIG. 12 is an exploded perspective view of the preferred embodiment of the invention.

FIG. 13 is a partial section side elevation view of the invention as shown in FIG. 12 installed into the sole of the shoe.

FIG. 14 is an end elevation view of FIG. 13.

DETAILED DESCRIPTION OF THE INVENTION

Figure 1:
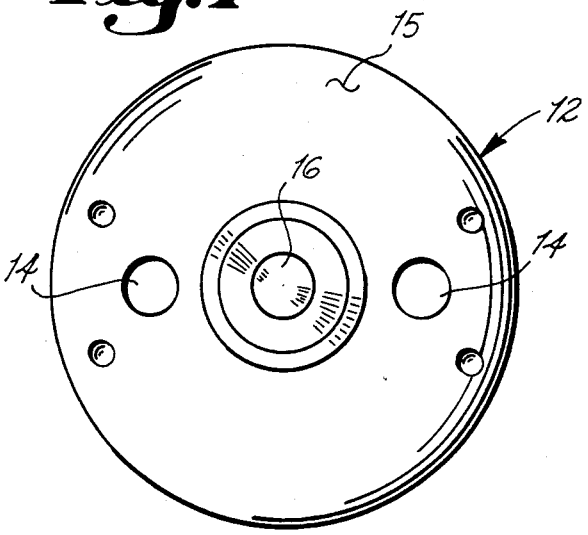
FIG. 1 is a bottom plan view of a golf spike adapted for use in conjunction with one embodiment of the invention.
Figure 2:
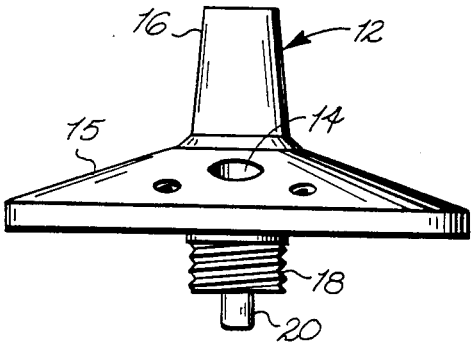
FIG. 2 is a typical side elevation view of the golf spike of FIG. 1.

Referring now to the drawings, and particularly to FIGS. 1 and 2, a modified version of an otherwise standard golf spike is shown generally at numeral 12. The golf spike 12 includes a typical flange 15 having opposing tightening holes 14 therethrough, a ground engaging portion 16 forming one end of the main portion of the spike 12 and a threaded shank 18 having a point or tip 20 disposed from the other distal end of the main portion of spike 12.

Referring additionally to FIGS. 3, 4, 5 and 6, one embodiment of the invention is shown generally at numeral 10 and includes the above described spike 12, holder 22, and transverse plate 28. The holder 22 has a centrally located interior thread 26 therethrough and also includes a groove 24 disposed transversely to the axis of the interior thread 26 as shown. The elongated, flat transverse plate 34 includes apertures 30 and 32 whose function and purpose will be discussed herebelow.

Figure 4:
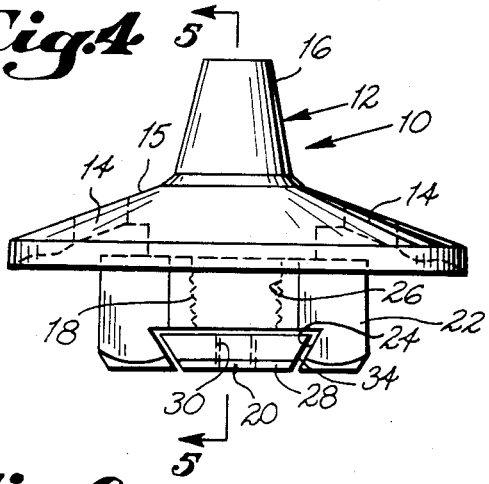
FIG. 4 is an end elevation view of the invention in FIG. 3.
Figure 5:
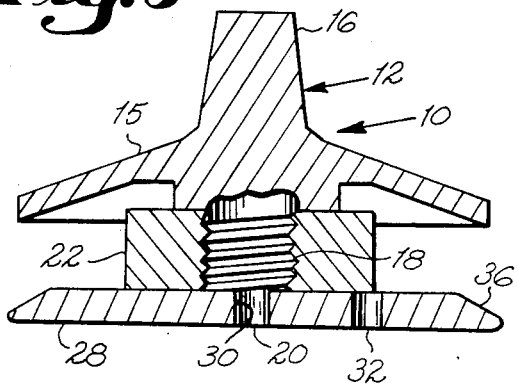
FIG. 5 is a section view of the invention in the direction of arrows 5—5 in FIG. 4.
Figure 6:
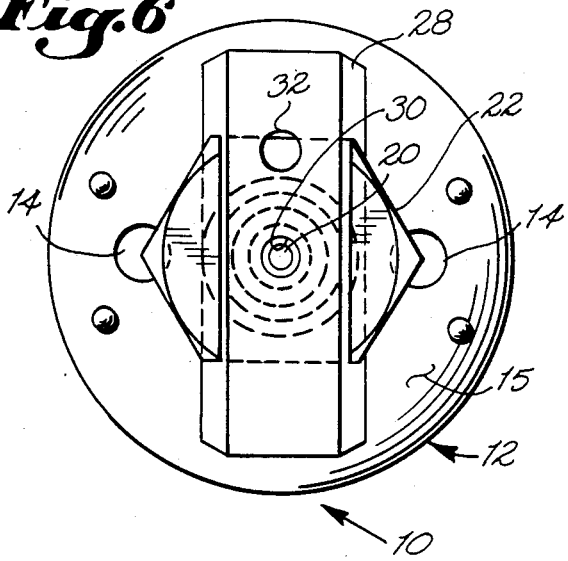
FIG. 6 is a bottom plan view of the invention shown in FIG. 3.

The edges of the groove 24 are mateably formed in dovetail fashion as best seen in FIG. 4 to mate with the side margins 34 of transverse plate 28 so as to retain and support the transverse plate 28 in a fixed but sliding orientation in relation to the holder 22 and its interior thread 26. By this arrangement, then, the transverse plate 28 may be slidably engaged into groove 24 and moved along until aperture 30 is in alignment and registry with the axis of both the interior thread 26 and the threaded shank 18 when installed therein. At this point, the golf spike 12 may be fully threadably engaged into the holder 22 whereby the tip 20 engages aperture 30 as best seen in FIGS. 4 and 5. After this assembly, the slidability of transverse plate 28 in holder 22 is secured and fixed.

Figure 3:
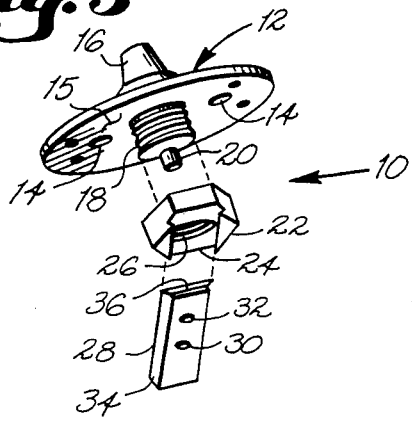
FIG. 3 is a perspective exploded view of one embodiment of the invention, including the golf spike of FIG. 1.

Referring now to FIGS. 7 through 11, one mode of installing the invention as shown in FIG. 3 is sequentially depicted. The sole S of the a shoe typically includes an upper layer S1 and a lower layer S2 which may be fabricated of leather, rubber or the like. These layers S1 and S2 are typically glued and/or stitched together during manufacture of the shoe, thus forming an interface surface therebetween. A cavity or hole C must be first prepared in the lower sole S2. This cavity C is sized and shaped to receive the holder 22. The transverse plate 28 is first slid into interengagement with groove 24 as previously described and shown in FIG. 8. It should be noted that the ends 36 of transverse plate 28 have been tapered as shown to facilitate the following installation steps. In FIG. 9, the assembly of FIG. 8 has been manipulated such that the transverse plate 28 has been wedged between the layers S1 and S2 as shown. In FIG. 10, the holder 22 and transverse plate 28 have been pushed into position wherein the holder 22 is within the cavity C. The final installation step is to slide the transverse plate 28 laterally, forcing the other tapered end of the transverse plate 28 between the sole layers S1 and S2 such that the transverse plate is evenly spaced over the cavity C and interior thread 26.

To facilitate the steps shown in FIG. 11, an additional aperture 32 has been provided which may be engaged with a tool such as a pointed awl to at least partially slide the transverse plate 28 toward the position shown in FIG. 11. At the point where aperture 32 becomes ineffective, aperture 30 is positioned such that it now is visible through interior thread 26 and may be engaged by the tool to complete the centering of transverse plate 28.

Referring now to FIGS. 12, 13 and 14, the preferred embodiment of the invention is shown generally at 40 and includes holder 42 and transverse plate 48 intended for use in conjunction with a conventional spike SP, such spikes having a threaded shank SP' forming one end as shown. Note that transverse plate 48 includes apertures 50 and 51 provided to facilitate the installation step depicted previously in FIG. 11 wherein the transverse plate 48 is slid laterally to a central position over cavity C'. This embodiment of the holder 42 is generally cylindrical and includes an interior thread 46 mateable over the threaded shank SP' and a transverse thru slot 44 adjacent to one end of the holder 42. The slot 44 is adapted to receive transverse plate 48 therethrough.

By the arrangement shown in FIG. 12, after the transverse plate 48 has been installed into slot 44, the spike may be threadably engaged into the holder 42 and, when tightened therein, the threaded shank SP' presses against the transverse plate 48, locking all components in the preselected orientation one to another.

The installation of the preferred embodiment 40 is effected by similar steps as depicted in FIGS. 7 through 11 previously described. The approximate arrangement and configuration of this embodiment 40 installed in relation to soles S1 and S2 into prepared cavity C' is depicted in FIGS. 13 and 14. Again, note that this embodiment 40 is used in conjunction with a conventional existing golf spike SP' and does not require modification thereto to effect installation and replacement of this embodiment 40.

By reviewing the installation steps of FIGS. 7 through 11 and the assembled arrangements shown in FIGS. 13 and 14, it should be now clear that both embodiments of the invention provide easy and convenient reversal of this installation procedure repeatedly so that as the holder 22 or 42 becomes corroded or deteriorated, replacement may be easily and quickly effected at minimal cost, thus preserving the otherwise usefulness of the shoes.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparati and articles.

I claim:

1. A replaceable retention system for mounting spikes, cleats and the like thereto in the sole of a shoe comprising:

an elongated transverse plate:

a holder adapted to be insertable into a prepared cavity in the shoe sole;

said holder having an interior threaded portion adapted to threadably receive the threaded shank of the spike;

said holder also structured to receive and support said transverse plate in a laterally slidable orientation perpendicular to said interior threaded portion whereby the spike retains said transverse plate in a particular lateral position with respect to said holder when the spike threaded portion is engaged and tightened in said holder.

2. A replaceable retention system as set forth in claim 1 used in conjunction with spikes having a point axially extending from the threaded portion and wherein said transverse plate also includes:

at least one aperture disposed through its center portion for receiving the spike point when the spike threaded portion is engaged and tightened into the holder.

3. A replaceable retention system as set forth in claim 2, wherein said transverse plate receiving and supporting structure of said holder includes:

a groove in said holder transversely disposed at one end of said interior threaded portion;

the edges of said groove and edge margins of said transverse plate having mating dovetail contours.

4. A replaceable retention system as set forth in claim 3, wherein:

the ends of said transverse plate are tapered.

5. A replaceable retention system as set forth in claim 4, further comprising:

at least one additional aperture disposed through said transverse plate for facilitating installation of said system with a pointed tool.

6. A replaceable retention system as set forth in claim 1, wherein said transverse plate receiving and supporting structure of said holder includes:

a slot transversely disposed through said holder adjacent one end thereof;

said transverse plate insertable through said transverse slot.

7. A replaceable retention system as set forth in claim 6, further comprising:

at least one additional aperture disposed through said transverse plate for facilitating installation of said system.

8. A replaceable retention system as set forth in claim 7, further comprising:

at least one additional aperture disposed through said transverse plate for facilitating installation of said system with a pointed tool.

* * * * *